US007012183B2

(12) United States Patent
Herre et al.

(10) Patent No.: US 7,012,183 B2
(45) Date of Patent: Mar. 14, 2006

(54) APPARATUS FOR ANALYZING AN AUDIO SIGNAL WITH REGARD TO RHYTHM INFORMATION OF THE AUDIO SIGNAL BY USING AN AUTOCORRELATION FUNCTION

(75) Inventors: Jürgen Herre, Buckenhof (DE); Jan Rohden, Ilmenau (DE); Christian Uhle, Ilmenau (DE); Markus Cremer, Ilmenau (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 88 days.

(21) Appl. No.: 10/713,691

(22) Filed: Nov. 14, 2003

(65) Prior Publication Data

US 2004/0094019 A1 May 20, 2004

Related U.S. Application Data

(63) Continuation of application No. PCT/EP02/05171, filed on May 10, 2002.

(30) Foreign Application Priority Data

May 14, 2001 (DE) ..... 101 23 281

(51) Int. Cl.
*G10H 1/40* (2006.01)

(52) U.S. Cl. ..... 84/611; 84/635; 84/651; 84/667

(58) Field of Classification Search ..... 84/600–608, 84/611, 635, 651, 667; 700/94; 704/237
See application file for complete search history.

(56) References Cited

U.S. PATENT DOCUMENTS 4,964,167 A 10/1990 Kunizawa et al.

(Continued)

FOREIGN PATENT DOCUMENTS

DE 38 23 724 A1 2/1989

(Continued)

OTHER PUBLICATIONS

Tolonen, T. et al.: "A Computationally Efficient Multipitch Analysis Model", IEEE Transactions on Speech and Audio Processing, vol. 8, No. 6, Nov. 2000, pp. 708-716.

(Continued)

*Primary Examiner*—Marlon T Fletcher
*Assistant Examiner*—David S. Warren
(74) *Attorney, Agent, or Firm*—Laurence A. Greenberg; Werner H. Stemer; Ralph E. Locher

(57) ABSTRACT

An apparatus for analyzing an audio signal with regard to rhythm information of the audio signal by using an autocorrelation function comprises a filter bank for separating the audio signal into at least two sub-band signals. The sub-band signals are examined with regard to periodicities by an autocorrelation function, to obtain rhythm raw-information for the at least two sub-band signals. To reduce or eliminate the ambiguities of the autocorrelation function for periodical signals, the rhythm raw-information is postprocessed to obtain post-processed rhythm raw-information for the sub-band signal. The rhythm information of the audio signal is established based on the postprocessed rhythm raw-information. By the sub-band-wise ACF postprocessing, ACF ambiguities are already eliminated where they originate, and rhythm portions are added at double tempi, which an autocorrelation function processing does normally not provide, so that, as a result, a more robust determination of the rhythm information of the audio signal arises.

11 Claims, 5 Drawing Sheets

U.S. PATENT DOCUMENTS

| | | | | |
|---|---|---|---|---|
| 5,918,223 | A | 6/1999 | Blum et al. | |
| 2004/0060426 | A1 * | 4/2004 | Weare et al. | 084/668 |

FOREIGN PATENT DOCUMENTS

| | | | |
|---|---|---|---|
| JP | 09293083 | A | 11/1997 |
| WO | 93/24923 | | 12/1993 |

OTHER PUBLICATIONS

Goto, M. et al.: "Real-Time Beat Tracking for Drumless Audio Signals: Chord Change Detection for Musical Decisions", Speech Communication, Elsevier Science B.V., vol. 27, 1999, pp. 311-335.

Scheirer, E. D.: "Tempo and Beat Analysis of Acoustic Musical Signals", Acoustical Society of America, vol. 103, No. 1, Jan. 1998, pp. 588-601.

Brown, J. C.: "Determination of the Meter of Musical Scores by Autocorrelation", The Journal of the Acoustical Society of America, Acoustical Society of America, vol. 94, No. 4, Oct. 1993, pp. 1953-1957.

Scheirer, E. D.: "Pulse Tracking With a Pitch Tracker", IEEE ASSP Workshop on New Paltz, Oct. 19, 1997, four pages.

* cited by examiner

APPARATUS FOR ANALYZING AN AUDIO SIGNAL WITH REGARD TO RHYTHM INFORMATION OF THE AUDIO SIGNAL BY USING AN AUTOCORRELATION FUNCTION

CROSS-REFERENCE TO RELATED APPLICATION

This application is a continuation of copending International Application No. PCT/EP02/05171, filed May 10, 2002, which designated the United States and was not published in English.

FIELD OF THE INVENTION

The present invention relates to signal processing concepts and particularly to the analysis of audio signals with regard to rhythm information.

DESCRIPTION OF THE RELATED ART

Over the last years, the availability of multimedia data material, such as audio or video data, has increased significantly. This is due to a series of technical factors, based particularly on the broad availability of the internet, of efficient computer hardware and software as well as efficient methods for data compression, i.e. source encoding of audio and video methods.

The huge amount of audio visual data, that are available worldwide, for example on the internet, require concepts, which make it possible, to be able to touch, catagolize, etc. these data according to content criteria. There is a demand to be able to search for and find multimedia data in a calculated way by specifying useful criteria.

This requires so-called "content-based" techniques, which extract so-called features from the audiovisual data, which represent important characteristic properties of the signal. Based on such features and combination of these features, respectively, similarity relations and common features, respectively, between audio or video signals can be derived. This is performed by comparing and relating, respectively, the extracted feature values from the different signals, which are also simply referred to as "pieces".

The determination and extraction, respectively, of features that do not only have signal-theoretical but immediate semantic meaning, i.e. represent properties immediately received by the listener, is of special interest.

This enables the user to phrase search requests in a simple and intuitive way to find pieces from the whole existing data inventory of an audio signal data bank. In the same way, semantically relevant features permit to model similarity relationships between pieces, which come close to the human perception. The usage of features, which have semantic meaning, enables also, for example, an automatic proposal of pieces of interest for a user, if his preferences are known.

In the area of music analysis, the tempo is an important musical parameter, which has semantic meaning. The tempo is usually measured in beats per minute (BPM). The automatic extraction of the tempo as well as of the bar emphasis of the "beat", or generally the automatic extraction of rhythm information, respectively, is an example for capturing a semantically important feature of a piece of music.

Further, there is a demand that the extraction of features, i.e. extracting rhythm information from an audio signal, can take place in a robust and computing-efficient way. Robustness means that it does not matter whether the piece has been source-encoded and decoded again, whether the piece is played via a loudspeaker and received from a microphone, whether it is played loud or soft, or whether it is played by one instrument or by a plurality of instruments.

For determining the bar emphasis and thereby also the tempo, i.e. for determining rhythm information, the term "beat tracking" has been established among the experts. It is known from the prior art to perform beat tracking based on note-like and transcribed, respectively, signal representation, i.e. in midi format. However, it is the aim not to need such metarepresentations, but to perform an analysis directly with, for example, a PCM-encoded or, generally, a digitally present audio signal.

The expert publication "Tempo and Beat Analysis of Acoustic Musical Signals" by Eric D. Scheirer, J. Acoust. Soc. Am. 103:1, (January 1998) pp. 588–601 discloses a method for automatical extraction of a rhythmical pulse from musical extracts. The input signal is split up in a series of subbands via a filter bank, for example in 6 sub-bands with transition frequencies of 200 Hz, 400 Hz, 800 Hz, 1600 Hz and 3200 Hz. Low pass filtering is performed for the first sub-band. High-pass filtering is performed for the last sub-band, bandpass filtering is described for the other intermediate sub-bands. Every sub-band is processed as follows. First, the sub-band signal is rectified. Put another way, the absolute value of the samples is determined. The resulting n values will then be smoothed, for example by averaging over an appropriate window, to obtain an envelope signal. For decreasing the computing complexity, the envelope signal can be sub-sampled. The envelope signals will be differentiated, i.e. sudden changes of the signal amplitude will be passed on preferably by the differentiating filter. The result is then limited to non-negative values. Every envelope signal will then be put in a bank of resonant filters, i.e. oscillators, which each comprise a filter for every tempo region, so that the filter matching the musical tempo is excited the most. The energy of the output signal is calculated for every filter as measure for matching the tempo of the input signal to the tempo belonging to the filter. The energies for every tempo will then be summed over all sub-bands, wherein the largest energy sum characterizes the tempo supplied as a result, i.e. the rhythm information. Contrary to auto correlation functions, it is advantageous that the oscillator bank reacts to a stimulus also with output signals at double, triple, etc. the tempo or also at rational multiples (such as ⅔, ¾ of the tempo. An auto correlation function does not have that property, it provides only output signals at one half, one third, etc. of the tempo.

A significant disadvantage of this method is the large computing and memory complexity, particularly for the realization of the large number of oscillators resonating in parallel, only one of which is finally chosen. This makes an efficient implementation, such as for real-time applications, almost impossible.

The expert publication "Pulse Tracking with a Pitch Tracker" by Eric D. Scheirer, Proc. 1997 Workshop on Applications of Signal Processing to Audio and Acoustics, Mohonk, N.Y., October 1997 describes a comparison of the above-described oscillator concept to an alternative concept, which is based on the use of autocorrelation functions for the extraction of the periodicity from an audio signal, i.e. the rhythm information of a signal. An algorithm for the modulation of the human pitch perception is used for beat tracking.

The known algorithm is illustrated in FIG. 3 as a block diagram. The audio signal is fed into an analysis filterbank 302 via the audio input 300. The analysis filterbank generates a number n of channels, i.e. of individual sub-band signals, from the audio input. Every sub-band signal contains a certain area of frequencies of the audio signal. The filters of the analysis filterbank are chosen such that they approximate the selection characteristic of the human inner ear. Such an analysis filterbank is also referred to as gamma tone filterbank.

The rhythm information of every sub-band is evaluated in means 304*a* to 304*c*. For every input signal, first, an envelope-like output signal is calculated (with regard to a so-called inner hair cell processing in the ear) and sub-sampled. From this result, an autocorrelation function (ACF) is calculated, to obtain the periodicity of the signal as a function of the lag.

At the output of means 304*a* to 304*c*, an autocorrelation function is present for every sub-band signal, which represents the rhythm information of every sub-band signal.

The individual autocorrelation functions of the sub-band signals will then be combined in means 306 by summation, to obtain a sum autocorrelation function (SACF), which reproduces the rhythm information of the signal at the audio input 300. This information can be output at a tempo output 308. High values in the sum autocorrelation show that a high periodicity of the note beginnings is present for a lag associated to a peak of the SACF. Thus, for example the highest value of the sum autocorrelation function is searched for within the musically useful lags.

Musically useful lags are, for example, the tempo range between 60 bpm and 200 bpm. Means 306 can further be disposed to transform a lag time into tempo information. Thus, a peak of a lag of one second corresponds, for example, a tempo of 60 beats per minute. Smaller lags indicate higher tempos, while higher lags indicate smaller tempos than 60 bpm.

This method has an advantage compared to the first mentioned method, since no oscillators have to be implemented with a high computing and storage effort. On the other hand, the concept is disadvantageous in that the quality of the results depends strongly on the type of the audio signal. If, for example, a dominant rhythm instrument can be heard from an audio signal, the concept described in FIG. 3 will work well. If, however, the voice is dominant, which will provide no particularly clear rhythm information, the rhythm determination will be ambiguous. However, a band could be present in the audio signal, which merely contains rhythm information, such as a higher frequency band, where, for example, a Hihat of drums is positioned, or a lower frequency band, where the large drum of the drums is positioned on the frequency scale. Due to the combination of individual information, the fairly clear information of these particular sub-bands is superimposed and "diluted", respectively, by the ambiguous information of the other sub-bands.

Another problem when using autocorrelation functions for extracting the periodicity of a sub-band signal is that the sum autocorrelation function, which is obtained by means 306, is ambiguous. The sum autocorrelation function at output 306 is ambiguous in that an autocorrelation function peak is also generated at a plurality of a lag. This is understandable by the fact that the sinus component with a period of t0, when subjected to an autocorrelation function processing, generates, apart from the wanted maximum at t0, also maxima at the plurality of the lags, i.e. at 2t0, 3t0, etc.

The expert publication "A Computationally Efficient Multipitch Analysis Model" by Tolonen and Karjalainen, IEEE Transactions on Speech and Audio Processing, Vol. 8, November 2000, discloses a computing time-efficient model for a periodicity analysis of complex audio signals. The calculating model divides the signal into two channels, into a channel below 1000 Hz and into a channel above 1000 Hz. There from, an autocorrelation of the lower channel and an autocorrelation of the envelope of the upper channel are calculated. Finally, the two autocorrelation functions will be summed. In order to eliminate the ambiguities of the sum autocorrelation function, the sum autocorrelation function is processed further, to obtain a so-called enhanced summary autocorrelation function (ESACF). This post-processing of the sum autocorrelation function comprises a repeated subtraction of versions of the autocorrelation function spread with integer factors from the sum autocorrelation function with a subsequent limitation to non-negative values.

It is a disadvantage of this concept that the ambiguities per sub-band obtained by the auto correlation function in the sub-bands are only eliminated in the sum auto correlation function but not immediately where they occur, namely in the individual sub-bands.

A further disadvantage of this concept is the fact that the auto correlation function itself does not provide any hint to the double, triple, . . . of the tempo, to which an auto correlation peak is associated.

SUMMARY OF THE INVENTION

It is the object of the present invention to provide an apparatus and a method for analyzing an audio signal with regard to rhythm information by using an auto correlation function, which is robust and computing-time-efficient.

In accordance with a first aspect of the invention, this object is achieved by an apparatus for analyzing an audio signal with regard to rhythm information of the audio signal by using an autocorrelation function, comprising: means for dividing the audio signal into at least two sub-band signals; means for examining at least one sub-band signal with regard to a periodicity in the at least one sub-band signal by an autocorrelation function, to obtain rhythm raw-information for the sub-band signal, wherein a delay is associated to a peak of the autocorrelation function; means for postprocessing the rhythm raw-information for the sub-band signal determined by the autocorrelation function, to obtain postprocessed rhythm raw-information for the sub-band signal, so that in the postprocessed rhythm raw-information an ambiguity in an integer plurality of a delay, to which an autocorrelation function peak is associated, is reduced, or a signal portion is added at an integer fraction of a delay, to which an autocorrelation function peak is associated; and means for establishing the rhythm information of the audio signal by using the postprocessed rhythm raw-information of the sub-band signal and by using another sub-band signal of the at least two sub-band signals.

In accordance with a second aspect of the invention, this aspect is achieved by an apparatus for analyzing an audio signal with regard to rhythm information of the audio signal by using an autocorrelation function, comprising: means for examining the audio signal with regard to a periodicity in the audio signal, to obtain rhythm raw-information for the audio signal, wherein a delay is associated to a peak of the autocorrelation function; means for postprocessing the rhythm raw-information for the audio signal determined by the autocorrelation function, to obtain postprocessed rhythm raw-information for the audio signal, so that in the postprocessed rhythm raw-information a signal portion is added at an integer fraction of a delay, to which an autocorrelation function peak is associated; and means for establishing rhythm information of the audio signal by using the post-processed rhythm raw-information of the audio signal.

In accordance with a third aspect of the invention, this object is achieved by an apparatus for analyzing an audio signal with regard to rhythm information of the audio signal by using an autocorrelation function, comprising: means for examining the audio signal with regard to a periodicity in the audio signal, to obtain rhythm raw-information information for the audio signal, wherein a delay is associated to a peak of the autocorrelation function; means for postprocessing the rhythm raw-information for the audio signal determined by the autocorrelation function, to obtain postprocessed rhythm raw-information for the audio signal, by subtracting a version of the rhythm raw-information weighted by a factor unequal one and spread by an integer factor larger than one; and means for establishing the rhythm information of the audio signal by using the postprocessed rhythm raw-information of the audio signal.

In accordance with a fourth aspect of the invention, this object is achieved by a method for analyzing an audio signal with regard to rhythm information of the audio signal by using an autocorrelation function, comprising: dividing the audio signal into at least two sub-band signals, examining at least one sub-band signal with regard to a periodicity in the at least one sub-band signal by an autocorrelation function, to obtain rhythm raw-information for the sub-band signal, wherein a delay is associated to a peak of the autocorrelation function; postprocessing the rhythm raw-information for the sub-band signal determined by the autocorrelation function, to obtain post-processed rhythm raw-information for the sub-band signal, so that in the postprocessed rhythm raw-information an ambiguity in the integer plurality of a delay, to which an autocorrelation function peak is associated, is reduced, or a signal portion is added at an integer fraction of a delay, to which an autocorrelation function peak is associated; and establishing the rhythm information of the audio signal by using the postprocessed rhythm raw-information of the sub-band signal and by using a further sub-band signal of the at least two sub-band signals.

In accordance with a fifth aspect of the invention, this object is achieved by a method for analyzing an audio signal with regard to rhythm information of the audio signal by using an autocorrelation function, comprising: examining the audio signal with regard to a periodicity in the audio signal, to obtain rhythm raw-information for the audio signal, wherein a delay is associated to a peak of the autocorrelation function; postprocessing the rhythm raw-information for the audio signal by the autocorrelation function, to obtain postprocessed rhythm raw-information for the audio signal, so that in the postprocessed rhythm raw-information a signal portion is added at an integer fraction of a delay, to which an autocorrelation function peak is associated; and establishing the rhythm information of the audio signal by using the postprocessed rhythm raw-information of the audio signal.

In accordance to a sixth aspect of the invention, this aspect is achieved by a method for analyzing an audio signal with regard to rhythm information of the audio signal by using an autocorrelation function, comprising: examining the audio signal with regard to a periodicity in the audio signal, to obtain rhythm raw-information for the audio signal, wherein a delay is associated to a peak of the autocorrelation function; postprocessing the rhythm raw-information for the audio signal determined by the autocorrelation function, to obtain postprocessed rhythm raw-information for the audio signal, by subtracting a version of the rhythm raw-information weighted with a factor unequal one and spread by an integer factor larger than one; and establishing the rhythm information of the audio signal by using the postprocessed rhythm raw-information of the audio signal.

The present invention is based on the knowledge that a postprocessing of an autocorrelation function can be performed sub-band-wise, to eliminate the ambiguities of the autocorrelation function for periodical signals, and tempo information, which an autocorrelation processing does not provide, respectively, are added to the information obtained by an autocorrelation function. According to an aspect of the present invention, an autocorrelation function postprocessing of the sub-band signals is used to eliminate the ambiguities already "at the root", and to add "missing" rhythm information, respectively.

According to another aspect of the present invention, postprocessing of the sum autocorrelation function is performed, to obtain postprocessed rhythm raw-information for the audio signal, so that in the postprocessed rhythm raw-information a signal part is added at an integer fraction of a delay, to which an autocorrelation function peak is associated. Thereby, it is possible to generate the rhythm information not obtained by an autocorrelation function in double, triple, etc. tempi and in rational pluralities, respectively, by calculating versions of the autocorrelation function compressed by an integer factor or by a rational factor, and by adding these versions to the original autocorrelation function. Contrary to the prior art, where an expensive oscillator bank is required therefore, according to the invention, this takes place with weighting and addition routines, which are easy to implement.

According to another aspect of the present invention, the sum autocorrelation function is further post-processed by subtracting a version of the rhythm raw-information to the autocorrelation function, which is weighted by a factor larger than zero and smaller than one, and spread by an integer factor larger than one. This has the advantage of eliminating the ACF ambiguities in the integer multiple of the delay, to which an autocorrelation peak is associated. While in the prior art no weighting of the spread versions of the autocorrelation function is performed prior to subtraction, and an elimination of the ambiguities is therefore only obtained in the theoretical optimum case, where the rhythm repeats itself ideally cyclically, the weighted subtraction provides the possibility to take rhythm information into account, which does not repeat itself ideally cyclically, by an appropriate choice of weighting factors, which can, for example, take place empirically.

According to a preferred embodiment of the present invention, an autocorrelation function postprocessing is performed, by combining the rhythm information determined by an autocorrelation function with compressed and/or spread versions of it. In the case of using the spread versions of the rhythm information, the spread versions are subtracted from the rhythm raw-information, while in the case of versions of the autocorrelation function compressed by integer factors, these compressed versions are added to the rhythm raw-information.

In a preferred embodiment of the invention, the compressed/spread version is weighted with a factor between zero and one prior to adding and subtracting.

According to another preferred embodiment of the present invention, a quality evaluation of the rhythm information is performed based on the post-processed rhythm raw-information to obtain a significance measure, such that the quality evaluation is no longer influenced by autocorrelation artifacts. Thus, a secure quality evaluation becomes possible, whereby the robustness of determining rhythm information of the audio signal can be increased further.

Alternatively, the quality evaluation can already take place prior to the ACF postprocessing. This has the advantage that, when a flat course of the rhythm raw-information is determined, i.e. no distinct rhythm information, an ACF postprocessing for the sub-band signal can be omitted, since this sub-band will anyway have no importance due to its hardly expressive rhythm information when determining rhythm information of the audio signal. In this way, the computing and memory effort can be reduced further.

In the individual frequency bands, i.e. the sub-bands, there are often differently favorable conditions for finding rhythmical periodicities. While, for example, in pop music often the area of the middle, such as around 1 kHz, the signal is dominated by a voice not corresponding to the beat, in the higher frequency areas, often mainly percussion sounds are present, such as the hihat of the drums, which allow a very good extraction of rhythmical regularities. In other words, different frequency bands contain a different amount of rhythmical information, depending on the audio signal, and have a different quality or significance for the rhythm information of the audio signal, respectively.

Therefore, according to the invention, the audio signal is first divided into sub-band signals. Every sub-band signal is examined with regard to its periodicity, to obtain rhythm raw-information for every sub-band signal. Thereupon, according to the present invention, an evaluation of the quality of the periodicity of every sub-band signal is performed to obtain a significance measure for every sub-band signal. A high significance measure indicates that clear rhythm information is present in this sub-band signal, while a low significance measure indicates that less clear rhythm information is present in this sub-band signal.

According to a preferred embodiment of the present invention, when examining a sub-band signal with regard to its periodicity, first, a modified envelope of the sub-band signal is calculated, and then an autocorrelation function of the envelope is calculated. The autocorrelation function of the envelope represents the rhythm raw-information. Clear rhythm information is present when the autocorrelation function shows clear maxima, while less clear rhythm information is present when the autocorrelation function of the envelope of the sub-band signal has less significant signal peaks or no signal peaks at all. An autocorrelation function, which has clear signal peaks, will thus obtain a high significance measure, while an autocorrelation function, which has a relatively flat signal form, will obtain a low significance measure. As discussed above, the artefacts of the autocorrelation functions will be eliminated according to the invention.

The individual rhythm raw-information of the individual sub-band signal are not combined only "blindly", but under consideration of the significance measure for every sub-band signal to obtain the rhythm information of the audio signal. If a sub-band signal has a high significance measure, it is preferred when establishing the rhythm information, while a sub-band signal, which has a low significance measure, i.e., which has a low quality with regard to the rhythm information, is hardly or, in the extreme case, not considered at all when establishing the rhythm information of the audio signal.

This can be implemented computing-time-efficiently in a good way by a weighting factor, which depends on the significance measure. While a sub-band signal, which has a good quality for the rhythm information, i.e., which has a high significance measure, could obtain a weighting factor of 1, another sub-band signal, which has a smaller significance measure, will obtain a weighting factor smaller than 1. In the extreme case, a sub-band signal, which has a totally flat autocorrelation function, will have a weighting factor of 0. The weighted autocorrelation functions, i.e. the weighted rhythm raw-information, will then simply be summed up. When merely one sub-band signal of all sub-band signals supplies good rhythm information, while the other sub-band signals have autocorrelation functions with a flat signal form, this weighting can, in the extreme case, lead to the fact that all sub-band signals apart from the one sub-band signal obtain a weighting factor of 0, i.e. are not considered at all when establishing the rhythm information, so that the rhythm information of the audio signal are merely established from one single sub-band signal.

The inventive concept is advantageous in that it enables a robust determination of the rhythm information, since sub-band signals with no clear and even differing rhythm information, respectively, i.e. when the voice has a different rhythm than the actual beat of the piece, do no dilute and "corrupt" the rhythm information of the audio signal, respectively. Above that, very noise-like sub-band signals, which provide a system autocorrelation function with a totally flat signal form, will not decrease the signal noise ratio when determining the rhythm information. Exactly this would occur, however, when, as in the prior art, simply all autocorrelation functions of the sub-band signals with the same weight are summed up.

It is another advantage of the inventive method, that a significance measure can be determined with small additional computing effort, and that the evaluation of the rhythm raw-information with the significance measure and the following summing can be performed efficiently without large storage and computing-time effort, which recommends the inventive concept particularly also for real-time applications.

BRIEF DESCRIPTION OF THE DRAWINGS

Preferred embodiments of the present invention will be discussed in more detail below with reference to the accompanying drawings in which.

DETAILED DESCRIPTION OF PREFERRED EMBODIMENTS

Figure 1:
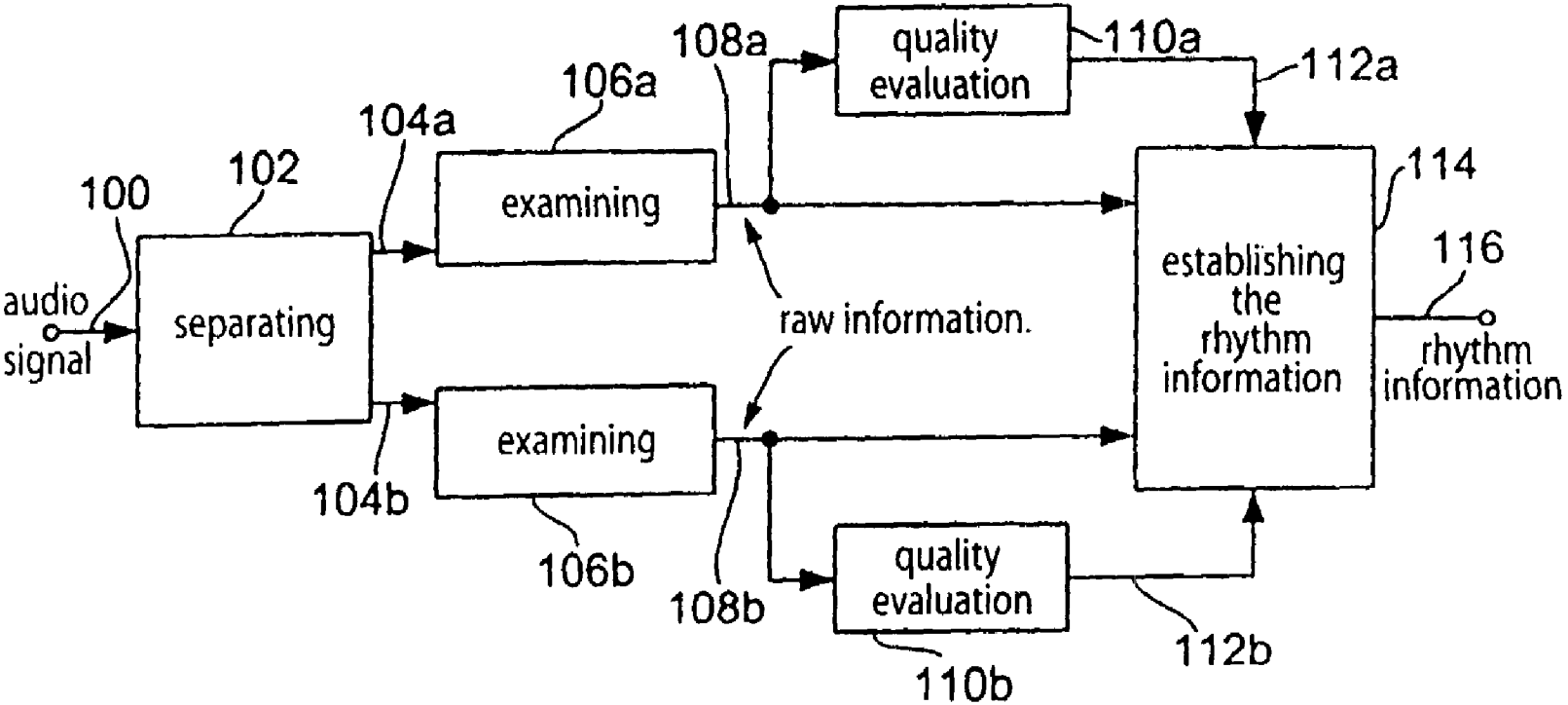
FIG. 1 a block diagram of an apparatus for analyzing an audio signal with a quality evaluation of the rhythm raw-information.

FIG. 1 shows a block diagram of an apparatus for analyzing an audio signal with regard to rhythm information. The audio signal is fed via input 100 to means 102 for dividing the audio signal into at least two sub-band signals 104*a* and 104*b*. Every sub-band signal 104*a*, 104*b* is fed into means 106*a* and 106*b*, respectively, for examining it with regard to periodicities in the sub-band signal, to obtain rhythm raw-information 108*a* and 108*b*, respectively, for every sub-band signal. The rhythm raw-information will then be fed into means 110*a*, 110*b* for evaluating the quality of the periodicity of each of the at least two sub-band signals, to obtain a significance measure 112*a*, 112*b* for each of the at least two sub-band signals. Both the rhythm raw-information 108*a*, 108*b* as well as the significance measures 112*a*, 112*b* will be fed to means 114 for establishing the rhythm information of the audio signal. When establishing the rhythm information of the audio signal, means 114 considers significance measures 112*a*, 112*b* for the sub-band signals as well as the rhythm raw-information 108*a*, 108*b* of at least one sub-band signal.

If means 110*a* for quality evaluation has, for example, determined that no particular periodicity is present in the sub-band signal 104*a*, the significance measure 112*a* will be very small, and equal to 0, respectively. In this case, means 114 for establishing rhythm information determines that the significance measure 112*a* is equal to 0, so that the rhythm raw-information 108*a* of the sub-band signal 104 will no longer have to be considered at all when establishing the rhythm information of the audio signal. The rhythm information of the audio signal will then be determined only and exclusively on the basis of the rhythm raw-information 108*b* of the sub-band signal 104*b*.

Figure 2:
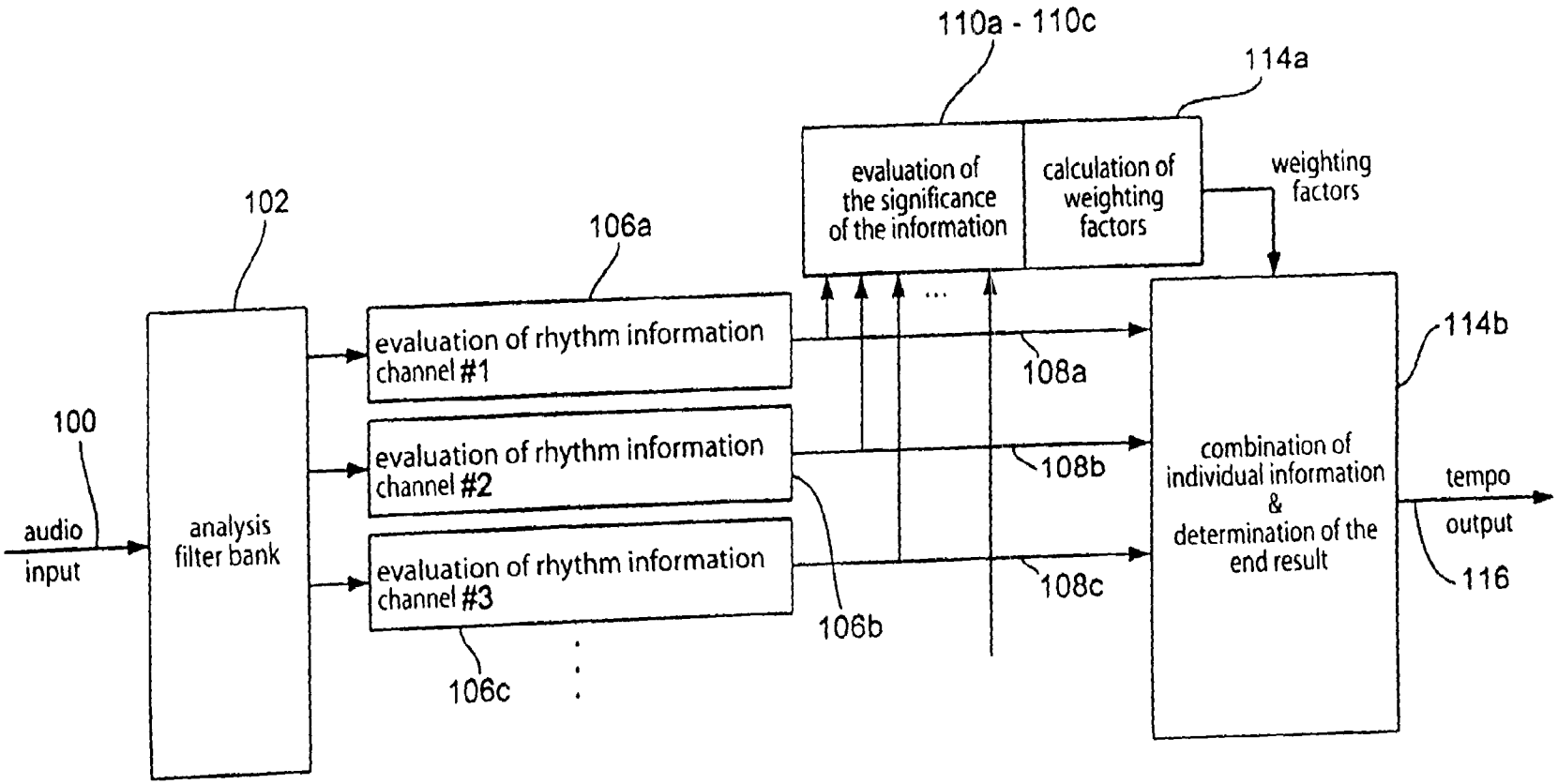
FIG. 2 a block diagram of an apparatus for analyzing an audio signal by using weighting factors based on the significance measures.
Figure 3:
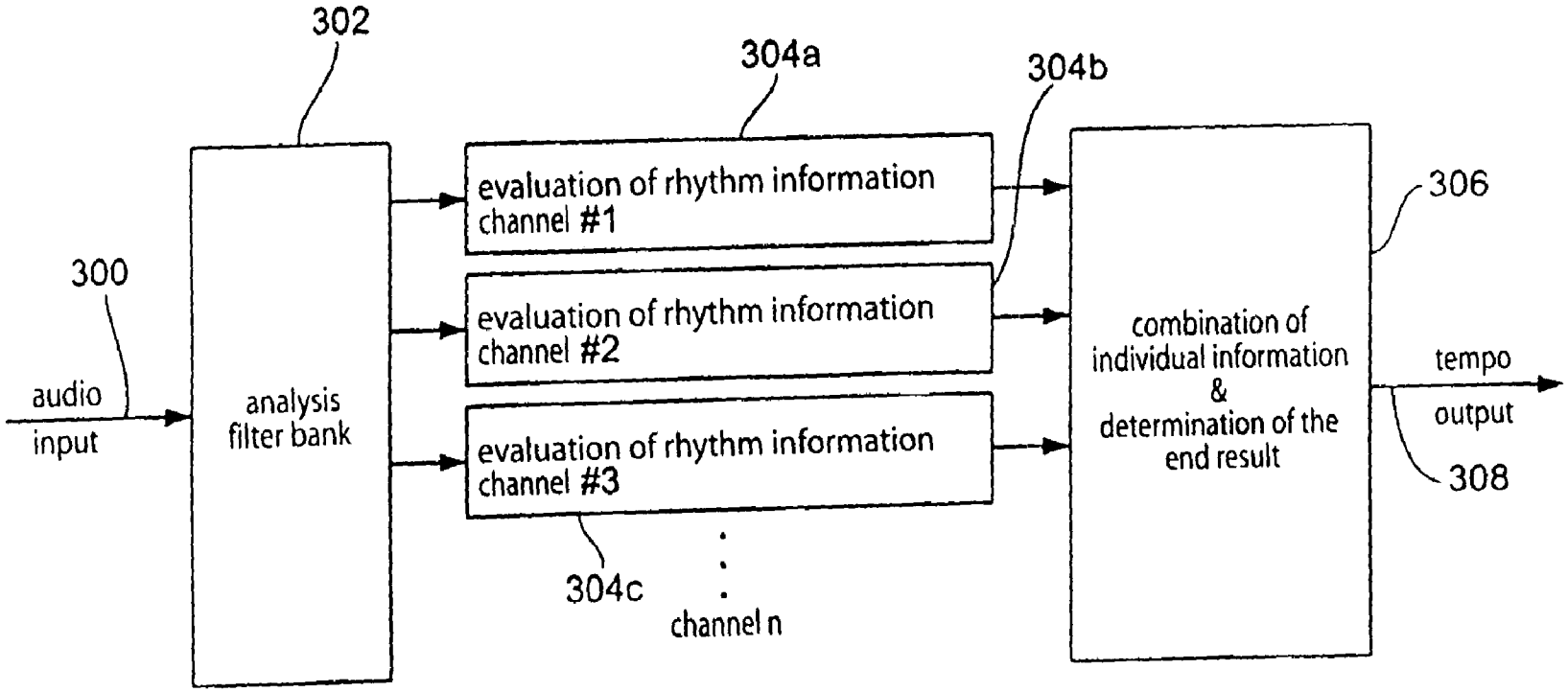
Fig. 3 (prior art)
FIG. 3 a block diagram of a known apparatus for analyzing an audio signal with regard to rhythm information.

In the following, reference will be made to FIG. 2 with regard to a special embodiment of the apparatus of FIG. 1. A common analysis filterbank can be used as means 102 for dividing the audio signal, which provides a user-selectable number of sub-band signals on the output side. Every sub-band signal will then be subjected to the processing of means 106*a*, 106*b* and 106*c*, respectively, whereupon significance measures of every rhythm raw-information will be established by means 110*a* to 110*c*. In the preferred embodiment illustrated in FIG. 2, means 114 comprises means 114*a* for calculating weighting factors for every sub-band signal based on the significance measure for this sub-band signal and optionally also of the other sub-band signals. Then, in means 114*b*, weighting of the rhythm raw-information 108*a* to 108*c* takes place with the weighting factor for this sub-band signal, whereupon then, also in means 114*b*, the weighted rhythm raw-information will be combined, such as summed up, to obtain the rhythm information of the audio signal at the tempo output 116.

Thus, the inventive concept is as follows. After evaluating the rhythmic information of the individual bands, which can, for example, take place by envelope forming, smoothing, differentiating, limiting to positive values and forming the autocorrelation functions (means 106*a* to 106*c*), an evaluation of the significance and the quality, respectively, of these intermediate results takes place in means 110*a* to 110*c*. This is obtained with the help of an evaluation function, which evaluates the reliability of the respective individual results with a significance measure. A weighting factor is derived from the significance measures of all sub-band signals for every band for the extraction of the rhythm information. The total result of the rhythm extraction will then be obtained in means 114*b* by combining the bandwidth individual results under consideration of their respective weighting factors.

As a result, an algorithm for rhythm analysis implemented in such a way shows a good capacity to reliably find rhythmical information in a signal, even under unfavorable conditions. Thus, the inventive concept is distinguished by a high robustness.

In a preferred embodiment, the rhythm raw-information 108*a*, 108*b*, 108*c*, which represent the periodicity of the respective sub-band signal, are determined via an autocorrelation function. In this case, it is preferred to determine the significance measure, by dividing a maximum of the autocorrelation function by an average of the autocorrelation function, and then subtracting the value 1. It should be noted that every autocorrelation function always provides a local maximum at a lag of 0, which represents the energy of the signal. This maximum should not be considered, so that the quality determination is not corrupted.

Further, the autocorrelation function should merely be considered in a certain tempo range, i.e. from a maximum lag, which corresponds to the smallest interesting tempo to a minimum lag, which corresponds to the highest interesting tempo. A typical tempo range is between 60 bpm and 200 bpm.

Alternatively, the relationship between the arithmetic average of the autocorrelation function in the interesting tempo range and the geometrical average of the autocorrelation function in the interesting tempo range can be determined as significance measure. It is known, that the geometrical average of the autocorrelation function and the arithmetical average of the autocorrelation function are equal, when all values of the autocorrelation function are equal, i.e. when the autocorrelation function has a flat signal form. In this case, the significance measure would have a value equal to 1, which means that the rhythm raw-information is not significant.

In the case of a system autocorrelation function with strong peaks, the ratio of arithmetic average to geometric average would be more than 1, which means that the autocorrelation function has good rhythm information. The smaller the ratio between arithmetic average and geometrical average becomes, the flatter is the autocorrelation function and the lesser periodicities it contains, which means that the rhythm information of this sub-band signal is less significant, i.e. will have a lesser quality, which will be expressed in a lower and a weighting factor of 0, respectively.

With regard to the weighting factors, several possibilities exist. A relative weighting is preferred, such that all weighting factors of all sub-band signals add up to 1, i.e. that the weighting factor of a band is determined as the significance value of this band divided by the sum of all significance values. In this case, a relative weighting is performed prior to the up summation of the weighted rhythm raw-information, to obtain the rhythm information of the audio signal.

Figure 4:
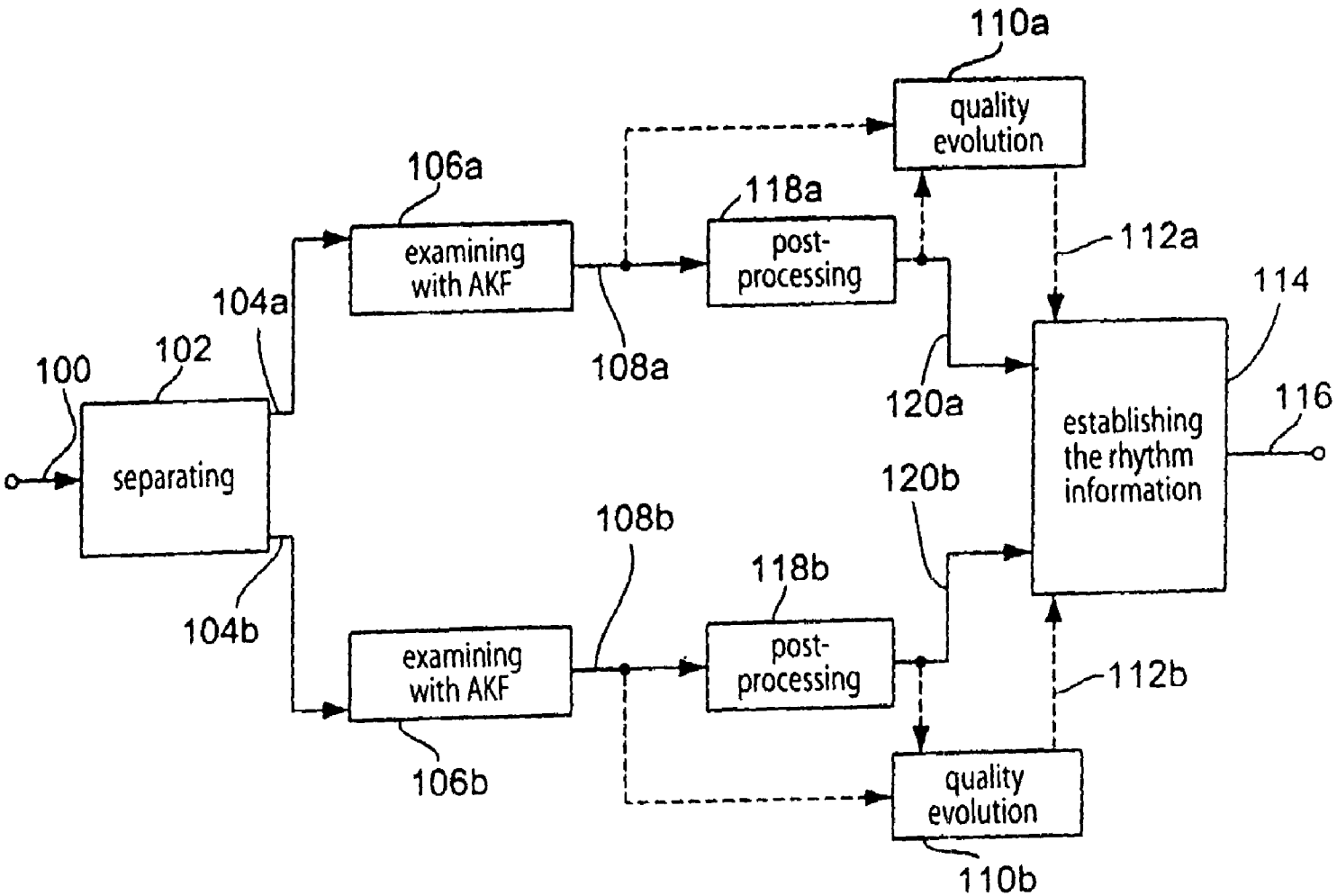
FIG. 4 a block diagram of an apparatus for analyzing an audio signal with regard to rhythm information by using an autocorrelation function with a sub-band-wise post-processing of the rhythm raw-information.

As it has already been described, it is preferred to perform the evaluation of the rhythm information by using an autocorrelation function. This case is illustrated in FIG. 4. The audio signal will be fed to means 102 for dividing the audio signal into sub-band signals 104*a* and 104*b* via the audio signal input 100. Every sub-band signal will then be examined in means 106*a* and 106*b*, respectively, as it has been explained, by using an autocorrelation function, to establish the periodicity of the sub-band signal. Then, the rhythm raw-information 108*a*, 108*b* is present at the output of means 106*a*, 106*b*, respectively. It will be fed into means 118*a* and 118*b*, respectively, to post-process the rhythm raw-information output by means 116*a* via the autocorrelation function. Thereby, it is insured, among other things, that the ambiguities of the autocorrelation function, i.e. that signal peaks occur also at integer pluralities of the lags, will be eliminated sub-band-wise, to obtain post-processed rhythm raw-information 120*a* and 120*b*, respectively.

This has the advantage that the ambiguities of the autocorrelation functions, i.e. the rhythm raw-information 108*a*, 108*b* are already eliminated sub-band-wise, and not only, as in the prior art, after the summation of the individual autocorrelation functions. Above that, the single band-wise elimination of the ambiguities in the autocorrelation functions by means 118*a*, 118*b* enables that the rhythm raw-information of the sub-band signals can be handled independent of another. They can, for example, be subjected to a quality evaluation via means 110*a* for the rhythm raw-information 108*a* or via means 110*b* for the rhythm raw-information 108*b*.

As illustrated by the dotted lines in FIG. 4, the quality evaluation can also take place with regard to post-process rhythm raw-information, wherein this last possibility is preferred, since the quality evaluation based on the post-processed processed rhythm raw-information ensures that the quality of information is evaluated, which is no longer ambiguous.

Establishing the rhythm information by means 114 will then take place based on the post-processed rhythm information of a channel and preferably also based on the significance measure for this channel.

When a quality evaluation is performed based on a rhythm raw-information, which means the signal prior to means 118*a*, this is advantageous in such, that, when it is determined, that the significance measure equals 0, i.e. that the autocorrelation function has a flat signal form, the post-processing via means 118*a* can be omitted fully to save computing-time resources.

Figure 5:
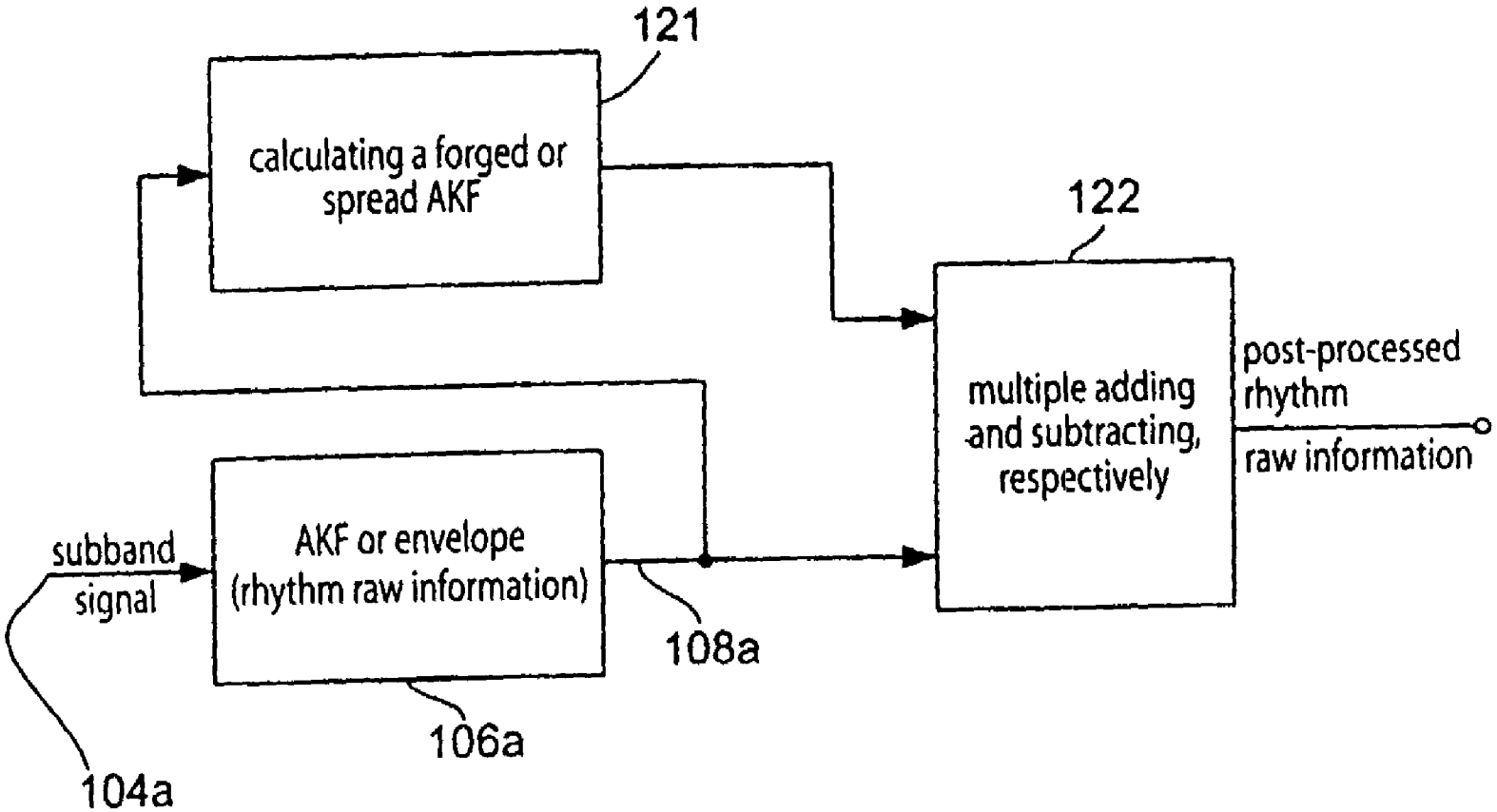
FIG. 5 a detailed block diagram of means for post-processing of FIG. 4.

In the following, reference will be made to FIG. 5, to illustrate a more detailed construction of means 118*a* or. 118*b* for post-processing rhythm raw-information. First, the sub-band signal, such as 104*a*, is fed into means 106*a* for examining the periodicity of the sub-band signal via an autocorrelation function, to obtain rhythm raw-information 108*a*. To eliminate the ambiguities sub-band-wise, a spread autocorrelation function can be calculated via means 121 as in the prior art, wherein means 128 is disposed to calculate the spread autocorrelation function such that it is spread by an integer plurality of a lag. Means 122 is disposed in this case to subtract this spread autocorrelation function from the original autocorrelation function, i.e. the rhythm raw-information 108*a*. Particularly, it is preferred to calculate first an autocorrelation function spread to double the size and subtract it then from the rhythm raw-information 108*a*. Then, in the next step, an autocorrelation function spread by the factor 3 is calculated in means 121 and subtracted again from the result of the previous subtraction, so that gradually all ambiguities will be eliminated from the rhythm raw-information.

Alternatively, or additionally, means 121 can be disposed to calculate an autocorrelation function forged, i.e. spread with a factor smaller 1, by an integer factor, wherein this will be added to the rhythm raw-information by means 122, to also generate portions for lags t0/2, t0/3, etc.

Above that, the spread and forged, respectively, version of the rhythm raw-information 108*a* can be weighted prior to adding and subtracting, respectively, to also obtain here a flexibility in the sense of a high robustness.

By the method of examining the periodicity of a sub-band signal based on a autocorrelation function, a further improvement can be obtained, when the properties of the autocorrelation function are incorporated and the post-processing is performed by using means 118*a* or 118*b*. Thus, a periodic sequence of note beginnings with a distance t0 does not only generate an ACF-peak at a lag t0, but also at 2t0, 3t0, etc. This will lead to an ambiguity in the tempo detection, i.e. the search for a significant maximum in the autocorrelation function. The ambiguities can be eliminated when versions of the ACF spread by integer factors are subtracted sub-band-wise (weighted) from the output value.

Above that, the compressed versions of the rhythm information 108*a* can be weighted with a factor unequal one prior to adding, to obtain a flexibility in the sense of high robustness here as well.

Further, there is the problem with the autocorrelation function that it provides no information at t0/2, t0/3 . . . etc., which means at the double or triple of the "base tempo", which will lead to wrong results, particularly, when two instruments, which lie in different sub-bands, define the rhythm of the signal together. This issue is considered by the fact that versions of the autocorrelation function forged by integer factors are calculated and added to the rhythm raw-information either weighted or unweighted.

Thus, ACF post-processing takes place sub-band-wise, wherein an autocorrelation function is calculated for at least one sub-band signal and this is combined with extended or spread versions of this function.

According to another aspect of the present invention, first, the sum autocorrelation function of the sub-bands is generated, whereupon versions of the sum autocorrelation function compressed by integer factors are added, preferably weighted to eliminate the inadequacies of the autocorrelation function in the double, triple, etc. tempo.

According to another aspect, the postprocessing of the sum autocorrelation function is performed to eliminate the ambiguities in the half, the third part, the second part, etc. of the tempo, by not just subtracting the versions of the sum autocorrelation function spread by integer factors, but weighting them prior to subtraction with a factor unequal one and preferably smaller than one and larger than zero, and to subtract them only then. Thereby, a more robust determination of the rhythm information becomes possible, since unweighted subtracting provides a full elimination of the ACF ambiguities merely for ideal sinusoidal signals.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. Apparatus for analyzing an audio signal with regard to rhythm information of the audio signal by using an autocorrelation function, comprising:

means for dividing the audio signal into at least two sub-band signals;

means for examining at least one sub-band signal with regard to a periodicity in the at least one sub-band signal by an autocorrelation function, to obtain rhythm raw-information for the sub-band signal, wherein a delay is associated to a peak of the autocorrelation function;

means for postprocessing the rhythm raw-information for the sub-band signal determined by the autocorrelation function, to obtain postprocessed rhythm raw-information for the sub-band signal, so that in the postprocessed rhythm raw-information an ambiguity in an integer multiple of a delay, to which an autocorrelation function peak is associated, is reduced compared to the rhythm raw-information before post processing, or a signal portion is added at an integer fraction of a delay, the integer fraction being determined by dividing "1" by an integer, to which an autocorrelation function peak is associated; and means for establishing the rhythm information of the audio signal by using the postprocessed rhythm raw-information of the sub-band signal and by using another sub-band signal of the at least two sub-band signals.

2. Apparatus according to claim 1, wherein the means for postprocessing comprises:

means for calculating a version of the rhythm raw-information of a sub-band signal spread by an integer factor; and means for subtracting the version of the rhythm raw-information of the sub-band signal spread by an integer factor larger than one, or a version of the rhythm raw-information of the sub-band signal derived from this version, to obtain the postprocessed rhythm raw-information for the sub-band signal.

3. Apparatus according to claim 2, wherein means for subtracting is disposed to perform, prior to subtracting, a weighting of the spread version with a factor between zero and one, to generate the derived version.

4. Apparatus according to claim 1, wherein means for postprocessing comprises:

means for calculating a version of the rhythm raw-information compressed by an integer factor larger than one; and means for adding the compressed version of the rhythm raw-information of the sub-band signal or a version derived therefrom to the rhythm raw-information of the sub-band signal, to obtain the postprocessed rhythm raw-information for the sub-band signal.

5. Apparatus according to claim 4, wherein the means for adding is disposed to perform, prior to adding, a weighting of the compressed version of the rhythm raw-information by a factor between zero and one, such that a weighted compressed version of the rhythm raw-information is added to the rhythm raw-information of the sub-band signal to generate the derived version.

6. Apparatus according to claim 1, further comprising:

means for evaluating a quality of the periodicity of the postprocessed rhythm raw-information, to obtain a significance measure for the sub-band signal, wherein means for establishing is further disposed to establish the rhythm information of the audio signal by considering the significance measure of the sub-band signal.

7. Method for analyzing an audio signal with regard to rhythm information of the audio signal by using an autocorrelation function, comprising:

dividing the audio signal into at least two sub-band signals, examining at least one sub-band signal with regard to a periodicity in the at least one sub-band signal by an autocorrelation function, to obtain rhythm raw-information for the sub-band signal, wherein a delay is associated to a peak of the autocorrelation function;

postprocessing the rhythm raw-information for the sub-band signal determined by the autocorrelation function, to obtain postprocessed rhythm raw-information for the sub-band signal, so that in the postprocessed rhythm raw-information an ambiguity in the integer multiple of a delay, to which an autocorrelation function peak is associated, is reduced compared to the rhythm raw-information before post processing, or a signal portion is added at an integer fraction of a delay, the integer fraction being determined by dividing "1" by an integer, to which an autocorrelation function peak is associated; and establishing the rhythm information of the audio signal by using the postprocessed rhythm raw-information of the sub-band signal and by using a further sub-band signal of the at least two sub-band signals.

8. Apparatus for analyzing an audio signal with regard to rhythm information of the audio signal by using an autocorrelation function, comprising:

means for examining the audio signal with regard to a periodicity in the audio signal, to obtain rhythm raw-information for the audio signal, wherein a delay is associated to a peak of the autocorrelation function;

means for postprocessing the rhythm raw-information for the audio signal determined by the autocorrelation function, to obtain postprocessed rhythm raw-information for the audio signal by adding a version of the rhythm raw information upset by an integer factor, so that in the postprocessed rhythm raw-information a signal portion is added at an integer fraction of a delay, the integer fraction being determined by dividing "1" by an integer, to which an autocorrelation function peak is associated; and means for establishing rhythm information of the audio signal by using the postprocessed rhythm raw-information of the audio signal.

9. Apparatus for analyzing an audio signal with regard to rhythm information of the audio signal by using an autocorrelation function, comprising:

means for examining the audio signal with regard to a periodicity in the audio signal, to obtain rhythm raw-information for the audio signal, wherein a delay is associated to a peak of the autocorrelation function;

means for postprocessing the rhythm raw-information for the audio signal determined by the autocorrelation function, to obtain postprocessed rhythm raw-information for the audio signal, by subtracting a version of the rhythm raw-information weighted by a factor unequal one and spread by an integer factor larger than one; and means for establishing the rhythm information of the audio signal by using the postprocessed rhythm raw-information of the audio signal.

10. Method for analyzing an audio signal with regard to rhythm information of the audio signal by using an autocorrelation function, comprising:

examining the audio signal with regard to a periodicity in the audio signal, to obtain rhythm raw-information for the audio signal, wherein a delay is associated to a peak of the autocorrelation function;

postprocessing the rhythm raw-information for the audio signal by the autocorrelation function, to obtain postprocessed rhythm raw-information for the audio signal by adding a version of the rhythm raw information upset by an integer factor, so that in the postprocessed rhythm raw-information a signal portion is added at an integer fraction of a delay, the integer fraction being determined by dividing "1" by an integer, to which an autocorrelation function peak is associated; and establishing the rhythm information of the audio signal by using the postprocessed rhythm raw-information of the audio signal.

11. Method for analyzing an audio signal with regard to rhythm information of the audio signal by using an autocorrelation function, comprising:

examining the audio signal with regard to a periodicity in the audio signal, to obtain rhythm raw-information for the audio signal, wherein a delay is associated to a peak of the autocorrelation function;

postprocessing the rhythm raw-information for the audio signal determined by the autocorrelation function, to obtain postprocessed rhythm raw-information for the audio signal, by subtracting a version of the rhythm raw-information weighted with a factor unequal one and spread by an integer factor larger than one; and establishing the rhythm information of the audio signal by using the postprocessed rhythm raw-information of the audio signal.

* * * * *